United States Patent [19]

Kulina

[11] 4,097,192

[45] Jun. 27, 1978

[54] TURBINE ROTOR AND BLADE CONFIGURATION

[75] Inventor: Mark R. Kulina, Franklin Lakes, N.J.

[73] Assignee: Curtiss-Wright Corporation, Wood-Ridge, N.J.

[21] Appl. No.: 757,302

[22] Filed: Jan. 6, 1977

[51] Int. Cl.[2] ..... F01D 5/10

[52] U.S. Cl. ..... 416/175; 416/228; 416/500

[58] Field of Search ..... 416/175, 203, 228, 500; 415/119

[56] References Cited

U.S. PATENT DOCUMENTS

| | | | |
|---|---|---|---|
| 1,639,247 | 8/1927 | Zoelly et al. | 416/190 |
| 1,970,435 | 8/1934 | Sharp | 416/228 |
| 2,292,072 | 8/1942 | Hanna et al. | 416/190 |
| 2,823,895 | 2/1958 | Floroff | 416/229 A |
| 2,916,258 | 12/1959 | Klint | 416/203 |
| 3,058,528 | 10/1962 | Hiersch | 416/203 |
| 3,347,520 | 10/1967 | Owczarek | 416/228 |
| 3,536,417 | 10/1970 | Stiefel et al. | 416/203 X |

FOREIGN PATENT DOCUMENTS

| | | | |
|---|---|---|---|
| 117,364 | 8/1943 | Australia | 416/145 |
| 1,340,331 | 9/1973 | France | 416/500 |

*Primary Examiner*—Everette A. Powell, Jr.
*Attorney, Agent, or Firm*—Arthur Frederick

[57] ABSTRACT

A rotor for compressors, turbines or the like and having a plurality of circumferentially-spaced blades in which every other blade is modified so that the average natural frequency of said modified blades differs from that of the other blades by at least 4% but by no more than 15% so as to reduce the maximum amplitude of turbine blade vibration.

5 Claims, 8 Drawing Figures

FIG. 1
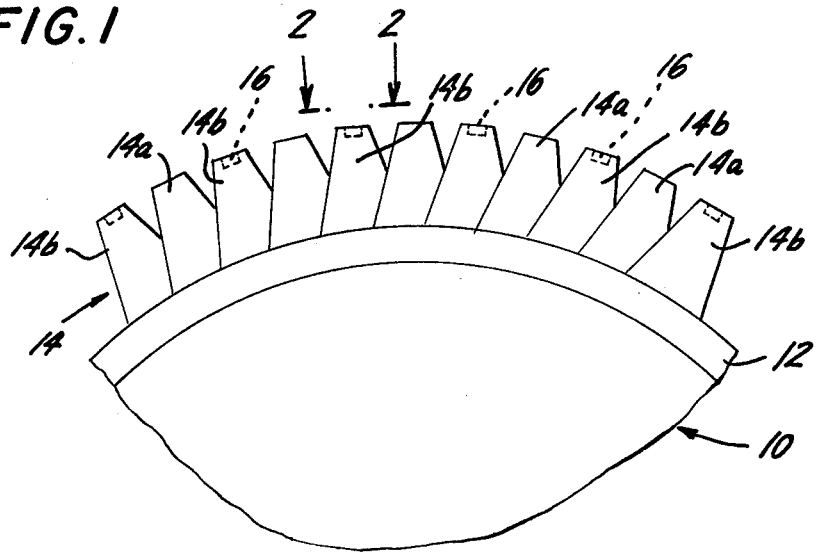
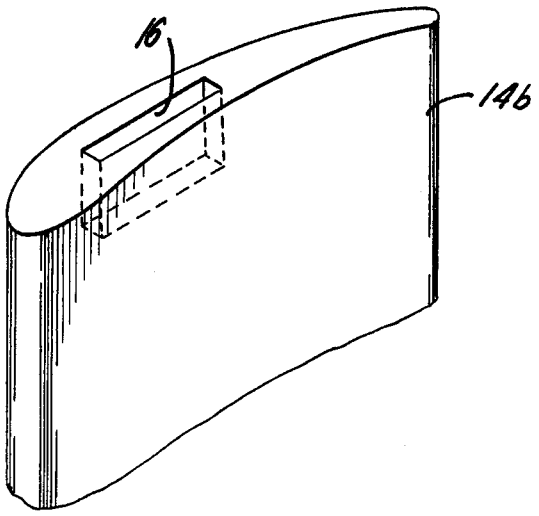
FIG. 2

TURBINE ROTOR AND BLADE CONFIGURATION

BACKGROUND OF THE INVENTION

The blades of rotary mechanisms such as compressors, turbines, or the like, are subject to severe stresses resulting from vibrations of such blades, particularly at resonate conditions. Various attempts have been made in the past to damp such vibrations or, as in U.S. Pat. No. 1,639,247 granted Aug. 16, 1927 to Zoelly et al, to change the natural frequency of the blades so that their natural frequency falls outside of the operating range of the mechanism. Thus, in this prior patent, two blades of different natural frequency are used with similar blades being disposed in groups with each group having a shroud inter-connected with the shroud of another group of blades of different natural frequency.

Another prior patent directed to this problem is U.S. Pat. No. 2,916,258 granted Dec. 8, 1959 to R. V. Klint in which all the blades are of different natural frequency or in which groups of blades of the same frequency are spaced from other groups of the same frequency.

SUMMARY OF THE INVENTION

An object of this invention is to provide a relatively simple and novel arrangement for reducing the amplitude of vibration of the blades of a rotary mechanism such as a compressor, turbine, or the like. This invention is herein described in connection with the blades of a turbine rotor but as will be apparent the invention is also applicable to the rotor blades of compressors, fans, and other similar rotary mechanisms.

Because of manufacturing tolerances, the natural frequency of vibration of the individual blades of a turbine rotor differ slightly. Thus, the spread of the natural frequencies of the individual rotor blades in general is about plus or minus two percent of the average natural frequency of these blades. Notwithstanding this spread of the natural frequency of vibration of the individual blades, it has been found that all the blades of a turbine rotor have their maximum amplitude of vibration at the same exciting frequency (same rotor speed) which is approximately the average of their natural frequencies of vibration. This common frequency resonance phenomenon has been verified experimentally by applicant and is herein called the "Neighborhood Vibration Theory". That is, all the blades of a turbine rotor having natural frequencies of vibration which are approximately the same although slightly different (that is, the magnitude of their natural frequencies of vibration are in the same neighborhood) respond to the same exciting frequency at resonance. This is only true if the natural frequency of vibration of the individual blades is in the neighborhood of the average of the natural frequencies of vibration of all the blades. Thus, if the natural frequency of vibration of an individual blade differs from the average by more than about 10%, it will resonate when the exciting frequency is equal to its own natural frequency instead of at the average natural frequency.

It has also been observed that the actual amplitude of vibration of the individual blades of a turbine rotor at the common or average resonance frequency is substantially less for those blades having a natural frequency which is different from said common resonant frequency. These results indicate that although the blades resonate at the same excitation frequency (rotor speed) the amplitude of vibration is less for those blades whose natural frequency of vibration differs from the common resonant frequency. The actual decrease in the amplitude of vibration of a particular blade increases with increase in the difference between natural frequency of vibration of that blade and the average of the natural frequencies of all the blades.

In the preferred embodiment of the present invention, half the blades of turbine rotor are modified to raise (or lower) their natural frequencies by at least four percent whereupon the average of all the blade natural frequencies is midway between that of the two groups of blades and this average frequency will be the common frequency at which all the blades resonate. Hence, since the spread of the natural frequencies of the blades, because of manufacturing tolerances, is only about plus or minus two percent, by changing the natural frequency of half the blades by four percent, the natural frequency of each of the blades will differ from the average natural frequency for all the blades and therefore in general the amplitude of vibration of each blade at this common or resonant frequency will be substantially reduced.

It therefore is an object of the present invention to provide a turbine rotor in which half the blades have their natural frequencies modified by at least four percent.

It is a further object of the invention to so modify the natural frequency of vibration of certain of the blades of a turbine rotor such that the average of the natural frequencies of all blades differs from that of any individual blade and to accomplish this without altering the external aerodynamic profile of each blade. In accordance with the invention, this result is accomplished by drilling or otherwise forming a cavity in the tip end of certain of the blades to raise the natural frequency of vibration of these blades.

Other objects of the invention will become apparent upon reading the following detailed description in connection with the drawings.

BRIEF DESCRIPTION OF DRAWINGS

FIG. 1 is an end view of a portion of a turbine rotor having blades embodying the invention;

FIG. 2 is an enlarged perspective view of a portion of a turbine blade embodying the invention and taken along line 2—2 of FIG. 1;

DESCRIPTION OF PREFERRED EMBODIMENTS

Figure 3:
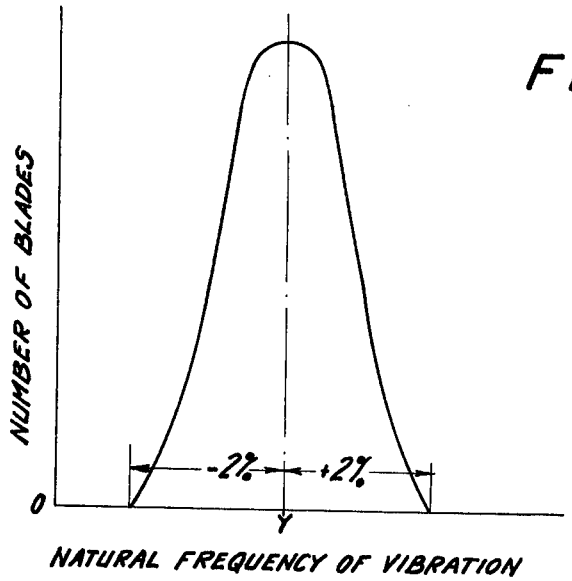
FIG. 3 is a graph showing the distribution of the natural frequencies of the individual blades in a conventional turbine.

Referring first to FIGS. 1 and 2 of the drawing, there is illustrated a turbine rotor 10 comprising a disc or annular portion 12 having a row of circumferentially-spaced blades 14 extending radially therefrom. Only a part of the rotor 10 and its row of blades is illustrated. In a conventional turbine rotor all its blades are substantially identical. In such a conventional turbine rotor, it is known that because of manufacturing tolerances, the natural frequencies of vibration of a row of circumferentially-spaced blades are not exactly the same and instead are spread over a small range. In general, the range or spread of the natural frequencies of vibration of the individual blades of a conventional turbine rotor is about plus or minus two percent of the average of the natural frequencies of all the blades.

This four percent spread of the natural frequency of vibration of the blades 14 of a conventional turbine rotor, is shown by the graph of FIG. 3. As shown in FIG. 3 the largest number of blades 14 have a natural frequency of vibration with the value Y, and the number of blades having a particular natural frequency of vibration progressively decreases the further the frequency is removed from Y. Also, as shown, the distribution of the natural frequencies of the blades is spread symmetrically on both sides of the frequency Y so that Y is the average of the natural frequencies of vibration of all the blades 14. Also, as illustrated by the graph of FIG. 3, the spread of the natural frequencies of the individual blades because of manufacturing tolerances is plus or minus two percent on either side of the average frequency Y.

As already stated, it has been found that notwithstanding this spread of their natural frequencies of vibration, all the blades of a row of turbine blades have their maximum amplitude of vibration when the exciting frequency (which is a function of rotor speed) is equal to said average frequency Y. In other words, all the blades apparently resonate at the same exciting frequency Y even though the natural frequencies of vibration of the individual blades is spread over a small range, for example, said four percent range. That is, each of the blades whose natural frequency of vibration is in the neighborhood of the average Y of the natural frequencies of vibration of all the blades, resonate at this average frequency. As previously stated, this phenomenon is herein called the Neighborhood Vibration Theory since it only applies to individual blades whose natural frequency of vibration is not too different from the average of the natural frequencies of all the blades. For example, a blade whose natural frequency of vibration differs from the average Y of said frequencies for all the blades by more than ten percent, and therefore probably is outside the Neighborhood of said average, would resonate when the exciting frequency coincided with its own natural frequency rather than at said average frequency.

It has also been observed that the amplitude of the vibration of each individual blade at resonance is less for those blades whose natural frequency of vibration, although in the neighborhood of the average of said frequencies for all the blades, is most removed from said average. In other words, although all the blades resonate at the same exciting frequency (average of their natural frequencies) that is, they all have their maximum amplitude of vibration at this common exciting frequency, the actual amplitude of their vibration is less for those blades whose natural frequency differs from this exciting frequency. This aspect of the Neighborhood Vibration Theory is illustrated in FIG. 4.

Figure 4:
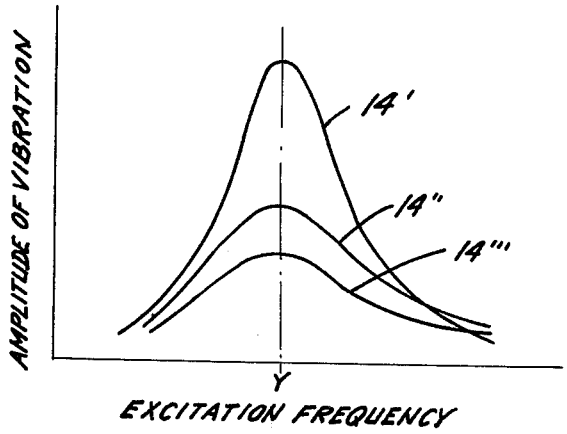
FIG. 4 is a graph comparing the amplitude of vibration of a blade whose natural frequency of vibration coincides with the average or resonant frequency of all the blades and blades whose natural frequency of vibration differs slightly from said resonant frequency.

FIG. 4 illustrates the amplitude of vibration of three turbine blades of a conventional turbine rotor over a range of exciting frequencies, one of the blades 14' having its natural frequency of vibration coinciding with the average Y of the natural frequencies of all the blades and the other two blades 14'' and 14''' having a natural frequency of vibration which is different from (for example, higher) but in the Neighborhood of said average frequency Y. As shown in FIG. 4, the blade 14' (whose natural frequency is the same as the average of all the blades) has a typical amplitude of vibration resonance curve which peaks rather sharply at the resonant frequency Y. On the other hand, the blade 14'' (whose natural frequency differs from but is in the Neighborhood of the resonant frequency Y) has a much flatter curve although its amplitude of vibration also is a maximum at the resonant frequency Y. Thus, as shown in FIG. 4 the maximum amplitude of vibration of the blade 14'' is substantially less than that of blade 14'. The blade 14''' whose natural frequency of vibration differs even more from the resonant frequency Y but still is in the Neighborhood of the frequency Y would, as shown in FIG. 4, have an even lower amplitude of vibration at the frequency Y and like the blade 14'' would have its maximum amplitude of vibration at this frequency.

In accordance with a preferred form of the invention, every other blade 14 has a similar cavity or recess 16 formed in its tip end, for example, by an electric arc cutting process or by drilling or other machining operation. Those blades 14 having no cavity or recess 16 are identified as **14*a* and those blades having a cavity or recess 16 are identified as 14*b*. The recesses 16 serves to similarly raise the natural frequency of vibration of each of the blades 14*b*. Each recess 16 is made sufficiently large to raise the natural frequency of vibration of its blade 14*b*** by at least 4 percent.

Figure 5:
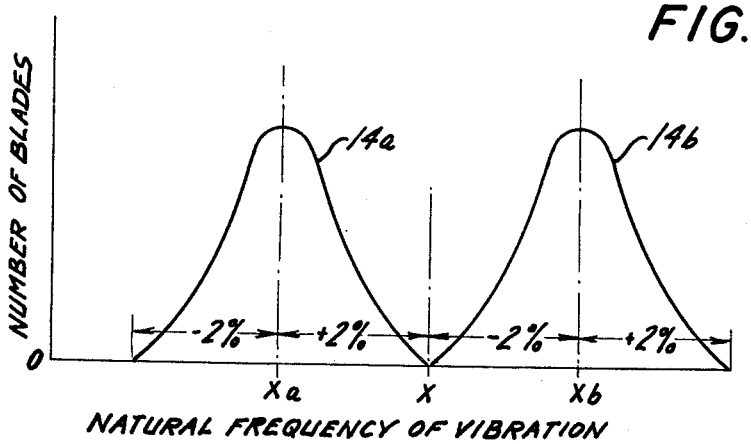
FIG. 5 is a graph similar to FIG. 3 but showing the distribution of the natural frequencies of the individual blades in a turbine embodying the invention.

FIG. 5 shows two graphs; the one designated A shows the distribution of the natural frequencies of vibration for the blades **14*a* and the other designated B shows the distribution for the blades 14*b*. Thus, each of the graphs, A and B, is similar to the graph of FIG. 3 but for only half of the blades. As shown in FIG. 5, the average of the natural frequencies of the blades 14*a*** is designated X*a* and the average of the natural frequencies of the blades **14*b*** is designated X*b*. As normally would be the case, because of manufacturing tolerances, the natural frequencies of vibration of each set of blades **14*a* and 14*b*** has a spread of four percent, that is, plus or minus 2 percent of the average of the natural frequencies of the blades of that set.

Since X*a* is the average of the natural frequencies of vibration of half the blades 14 (the blades **14*a***) and X*b* is the average of the natural frequencies of vibration of the other half of the blades (the blades **14*b***), the average of the natural frequencies of all the blades is midway between the frequencies X*a* and X*b* and is designated X in FIG. 5. Since the recesses 16 are designed to raise the natural frequency of vibration of the blades **14*b*** by at least four percent, the average X*b* of the natural frequencies of this set of blades will be at least four percent higher than that of X*a* for the set of blades **14*a*. Also, since the spread or distribution of the natural frequencies of vibration of the blades of each set is only plus or minus 2 percent, the average X of the natural frequencies of all the blades will, as shown in FIG. 5, fall between the natural frequencies of vibration of the individual blades of each set 14*a* and 14*b***.

It is apparent, therefore, that by so modifying half of the blades 14 by providing them with the cavities 16, the natural frequency of vibration of each of the blades 14*a* and 14*b* will differ from the resonant frequency X which is the average of the natural frequencies of all the blades 14*a* and 14*b*. Therefore, the amplitude of vibration of each of the blades 14*a* and 14*b* at the resonant frequency X will be substantially less than what it would be if its natural frequency of vibration coincided with said resonant frequency X. It is also apparent from FIG. 5 that with this modificaton of half the blades 14, for most of the blades, the difference between its natural frequency of vibration and the average X of the natural frequencies for all the blades, is substantially increased. Accordingly, as described in connection with FIG. 4, the maximum amplitude of vibration of most of the blades 14*a* and 14*b* will be materially reduced.

As discussed, the blades of a row of turbine blades whose natural frequency of vibration is in the Neighborhood of the average of the natural frequencies of all the blades of the row will resonate when the exciting frequency is equal to this average frequency whereas a blade whose natural frequency of vibration is too far removed from said average (outside the Neighborhood) will resonate when the exciting frequencies coincides with its own natural frequency of vibration. Just how far the natural frequency of vibration of blade must differ from the average of the natural frequencies of vibration of all the blades to resonate at its own frequency instead of at said average will depend on many factors such as blade size, blade shape, blade attachment configuration, the geometry of the rotor disc particularly in the region of attachment to the blades, as well as on other physical properties of the blades and rotor disc. In general, however, if the natural frequency of vibration of a blade differs by no more than about plus or minus (6%) from said average, it will resonate when the exciting frequency is equal to the average whereas if it differs by more than about (10%) it probably will resonate when the exciting frequency coincides with its own natural frequency of vibration.

In the embodiment described, every other blade in a row of circumferentially-spaced blades 14 is modified by providing it with a cavity 16 in its tip end. In this way, the modification of half the blades 14 does not upset the balance of the rotor, at least not when the total number of blades is an even number. In case of an odd number of blades, any unbalance caused by two blades 14*a* or 14*b* being adjacent to each other can readily be balanced. Another important feature of the invention is that alteration of the blades 14*b* by means of the tip cavity 16 does not alter the aerodynamic profile of the blades.

Figure 6:
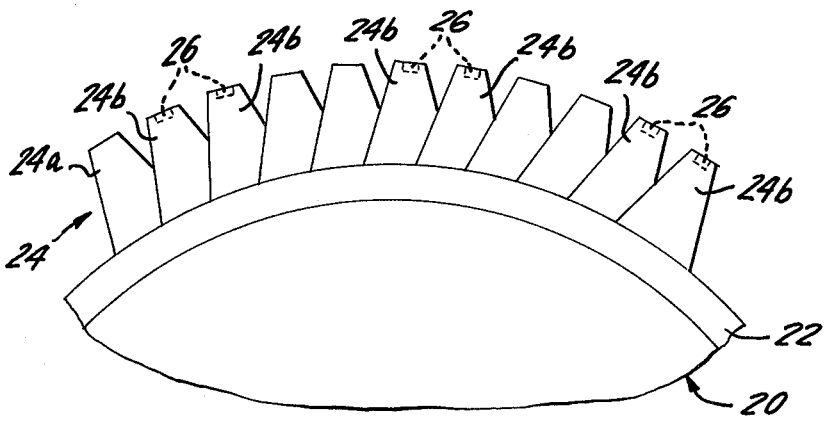
FIG. 6 is a view similar to FIG. 1 but illustrating a modified form of the invention.

The invention is not limited to modifying every other blade 14 to change its natural frequency of vibration. For example, the blades could be modified in pairs as shown in FIG. 6 without upsetting the rotor balance. As there illustrated, a turbine rotor 20 has an annular portion 22 with a row of circumferentially-spaced blades 24. Every other adjacent pair of blades 24 is modified by providing it with a recess or cavity 26 in its tip end similar to the cavity 16. The unmodified blades are designated 24*a* and the modified blades are designated 24*b* and the distribution of their natural frequencies of vibration is essentially the same as shown in FIG. 5 for the blades 14*a* and 14*b*. This modification of FIG. 6 of blades 24*b* of the turbine 20 results in substantially the same reduction in the amplitude of blade vibration as results from the modification of the turbine blades 14*b* in FIG. 3.

Figure 7:
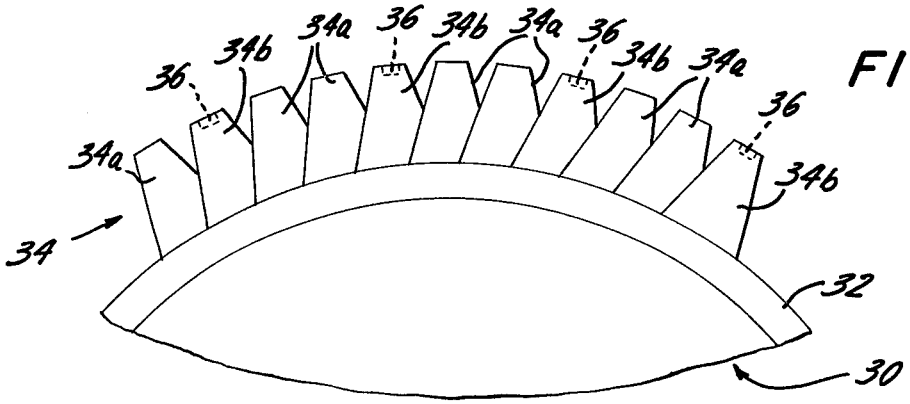
FIG. 7 is another view similar to FIG. 1 and illustrating still another modified form of the invention.

It is also not necessary that one-half of the blades of a row of circumferentially-spaced blades be modified to change their natural frequency of vibration. For example, as illustrated in FIG. 7, it is also within the scope of the invention to modify every third blade. As in the embodiments of FIGS. 1 and 6, such an embodiment also would not alter the balance of the turbine rotor.

In FIG. 7, a turbine rotor 30 is illustrated as having an annular portion 32 with a row of circumferentially-spaced blades 34 extending from said annular portion. In FIG. 7 every third blade 34 is modified by providing it with a cavity or recess 36 in its tip end. The unmodified blades are designated 34*a* and the modified blades are designated 34*b*. Now, however, the cavity or recess 36 is designed to raise the natural frequency of vibration of its blades by six percent (6%) instead of four percent (4%) as described in connection with FIGS. 1 and 6. At this point, it should be noted that the modifications of FIGS. 1 and 6 are not limited to four percent differences between the average of the natural frequency of vibration of the two groups of blades. For example since, in general, a blade is within the Neighborhood of the average of the natural frequencies of all the blades as long as its natural frequency of vibration is within ten percent of said average, the difference between the average natural frequency for the two groups of blades could be as much as fifteen percent.

Figure 8:
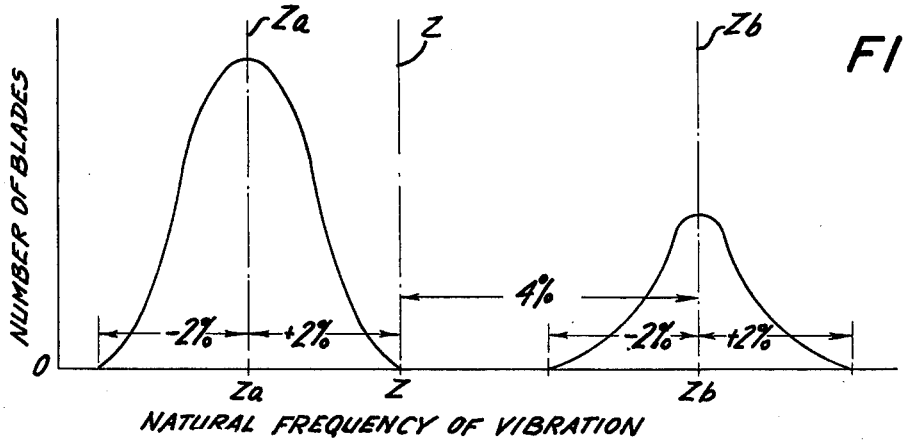
FIG. 8 is a view similar to FIG. 5 but applicable to the embodiment of FIG. 7.

FIG. 8 is a graph showing the distribution of the natural frequencies of vibration of the individual blades of the embodiment of FIG. 7. As there shown, since the modified blades 34*b* constitute only one-third the total number of blades 34, the average Z of the natural frequencies of vibration of all the blades 34 is not midway (as in FIG. 5) between average *Za* of the natural frequency of the blades 34*a* and the average *Zb* of the natural frequency of vibration of the blades 34*b*. Instead, as shown in FIG. 8, since there are twice as many unmodified blades 34*a* as there are modified blades 34*b*, the frequency difference between the average frequency Z of vibration of all the blades 34 and the average frequency *Za* for the blades 34*a* is only one-half the frequency difference between said average frequency Z and the average frequency *Zb* for the blades 34*b*. Hence, if as stated, the frequency difference between the averages *Za* and *Zb* is about six percent, then the combined average Z would be two percent above the average frequency *Za* of the blades 34*a* and four percent below the average frequency *Zb* of the blades 34*b*. Therefore, since because of manufacturing tolerances, the spread of the frequency of vibration of blades 34*a* is only plus or minus two percent and the spread of the frequency of vibration of the blades 34*b* is also only about plus or minus 2 percent, the average frequency of vibration Z of all the blades does not coincide with the individual frequency of vibration of any of the blades. It is clear, therefore, that as in the embodiments of FIGS. 1 and 6, the embodiment of FIG. 7 will also serve to reduce the amplitude of vibration of the blades 34*a* and 34*b*.

In each of the modifications described, the natural frequency of vibration of certain of the blades of a turbine rotor have been modified by forming a cavity or recess (16, 26, or 36) in their tip ends. The invention, however, is not limited to this specific manner of modifying the frequency of vibration. For example, each such cavity could be filled with a material which would serve to lower the blades natural frequency. It is important, however, that in modifying a blade to alter its natural frequency of vibration, that its external aerodynamic profile remain unchanged.

It is known that turbine blades may resonate at more than one frequency, the lowest being called its fundamental frequency of vibration and the others being harmonics of that frequency. The invention herein described can be directed to any of these resonating frequencies and may even function to reduce the amplitude of vibration at more than one of these frequencies, for example, where the blades of a turbine have two or more resonating frequencies of vibration within the operating range of its turbine.

From what has been said it should be clear that the invention is not limited to the specific details herein described and that changes and modifications may occur to one skilled in the art without departing from the spirit or scope of the invention.

What is claimed is:

1. A rotor for turbines, compressors or the like comprising an annular portion and a plurality of circumferentially-spaced blades each secured at one end to and projecting from said annular portion with the other end of said blades being free of any contact with each other, certain of said blades having means differentiating said blades from the remainder of said blades to provide two sets of blades in which, except for said differentiating means, the blades of each set are similar to the other blades of said set except for differences resulting from manufacturing tolerances such that, because of said differentiating means, the average of the natural frequencies of vibration of one of said two sets of blades differs from the corresponding average of the other set of said blades by a minimum percentage at least equal to the percentage spread of the natural frequencies of vibration of said blades resulting from manufacturing tolerances but no more than about 15%.

2. A rotor for turbines, compressors or the like as claimed in claim 1 in which the blades of each set are spaced about the axis of said rotor so as not to disturb its balance and said minimum percentage is at least about 4%.

3. A rotor for turbines, compressors or the like as claimed in claim 2 in which the blades of each set alternate with the blades of the other set.

4. A rotor for turbines, compressors or the like as claimed in claim 1 in which each of the blades of one set has a similar cavity formed in and opening out through its said other end for differentiating the blades of said one set from the blades of the other set such that said minimum percentage is at least about 4%.

5. A rotor for turbines, compressors or the like as claimed in claim 4 in which said cavity is formed in the other end of every other blade.

* * * * *